United States Patent [19]

Fritz

[11] 4,433,670

[45] Feb. 28, 1984

[54] ENGINE IGNITION SYSTEM

[75] Inventor: Adolf R. Fritz, Stuttgart, Fed. Rep. of Germany

[73] Assignee: Robert Bosch GmbH, Stuttgart, Fed. Rep. of Germany

[21] Appl. No.: 374,254

[22] Filed: May 3, 1982

[30] Foreign Application Priority Data

May 12, 1981 [DE] Fed. Rep. of Germany ..... 3118680

[51] Int. Cl.[3] ..... F02P 1/00

[52] U.S. Cl. ..... 123/644; 123/609

[58] Field of Search ..... 123/609, 610, 644

[56] References Cited

U.S. PATENT DOCUMENTS

| | | | |
|---|---|---|---|
| 4,153,032 | 5/1979 | Chateau | 123/644 |
| 4,267,813 | 5/1981 | Hohne | 123/609 |
| 4,280,461 | 7/1981 | Okuda | 123/644 |
| 4,356,808 | 11/1982 | Bodig | 123/644 |
| 4,366,800 | 1/1983 | Seeger | 123/644 |
| 4,391,262 | 7/1983 | Schleupen | 123/609 |

*Primary Examiner*—Ronald B. Cox

*Attorney, Agent, or Firm*—Frishauf, Holtz, Goodman & Woodward

[57] ABSTRACT

The period of conduction of an electronic interrupter of an ignition circuit is made shorter increasingly with falling engine speed in comparison to the duration of the period for which the switching path of the engine driven timing generator maintains its condition immediately before the ignition moment. During the time in which that condition is maintained immediately before changing at the ignition moment a capacitor (26) is provided with a first change (b) of its charge in a first direction and thereafter a second change (c) thereof is produced in the other direction. The switching of the electronic interrupter (7) into the conducting condition occurs when the charge of the capacitor reaches a threshold value during the second change of the charge. That threshold value is modifiable by a regulating value that depends at least in part on the engine speed. A monitoring circuit (39) is provided for the capacitor and provides a signal when the charge reaches a reference value which corresponds to the charge that can be reached at an engine speed that lies below the idling of the engine. The signal of the monitoring circuit is used to modify the regulating value that alters the threshold charge value, so that the threshold is reached sooner.

14 Claims, 4 Drawing Figures

ENGINE IGNITION SYSTEM

This invention concerns an ignition system for an internal combustion engine, such as a motor vehicle engine of the kind comprising an ignition coil with primary and secondary windings, an interrupter switch in series with the primary winding, an engine driven timing generator controlling a switching path in its output to provide a signal for causing the interrupter switch to go from its conducting state into its blocking state to produce a spark in the engine, with the provision of an electric storage circuit for providing a voltage which rises and falls during the ignition cycle and determines, when the voltage passes a certain threshold voltage, when the interrupter switch will be returned to its conducting condition for building up current in the ignition coil. In such circuits, the threshold voltage is modified by application of a regulating value that depends at least in part on engine speed to provide a suitable shift of the closing time for the interrupter switch.

An ignition system of this kind is known from German published patent application DE-OS 2 925 235. In this circuit, however, if the engine is running at a speed less than the idling speed and is suddenly caused to speed up rapidly, there can be a temporary failure of ignition.

SUMMARY OF THE INVENTION

It is an object of the present invention to overcome the difficulty just mentioned.

Briefly, a monitoring circuit is provided for the electric storage circuit just mentioned. The monitoring circuit provides a signal when the stored charge reaches a reference level. This reference value is reached by the stored charge at a speed that lies below the idling speed of the engine. The signal of the monitoring circuit just mentioned is utilized to modify a regulating value which is also used to shift the above-mentioned threshold in accordance with engine speed, to cause a change in the stored charge in such a way as to advance in time that phase of the stored voltage cycle during which the closing of the interrupter is produced. Preferably the changes in charge in the storage circuit take place at constant current and the storage member of the storage circuit is a capacitor. Various other features of the preferred circuit are of significance, but are not mentioned here, because they need to be described with reference to the drawings in order to be adequately understood.

The invention is further described, therefore, by way of illustrative example, with reference to the annexed drawings, in which.

DESCRIPTION OF THE ILLUSTRATED EMBODIMENTS

Figure 1:
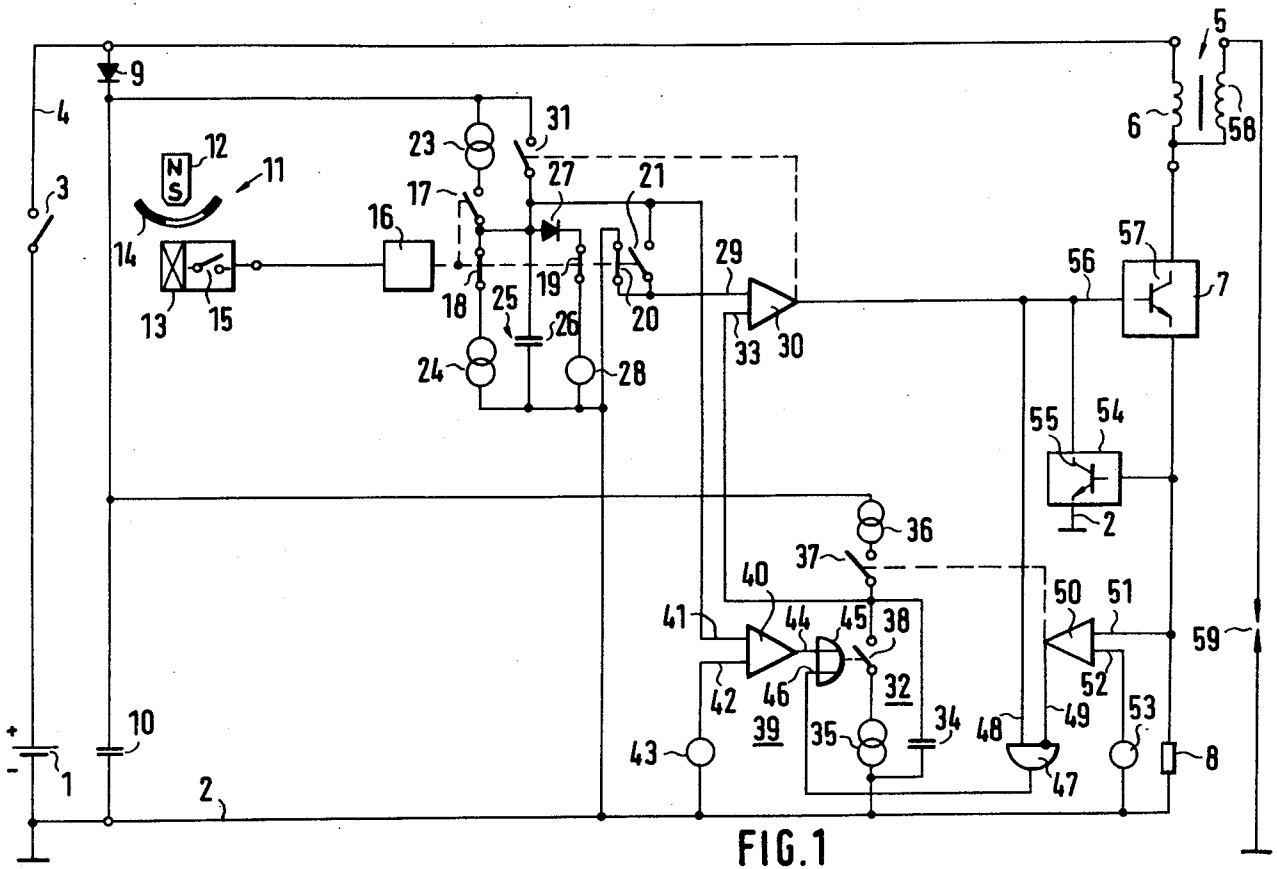
FIG. 1 is a circuit diagram of an ignition system according to the invention.

The ignition system shown in FIG. 1 is intended for an internal combustion engine not shown in the drawing that powers a motor vehicle likewise not shown. The ignition system is supplied with electric power from a d.c. source 1 which can, for example, be the motor vehicle's storage battery. A ground or chassis line 2 runs from the negative pole of the current source 1 and a supply bus 4 runs from the positive pole of the current source to the operating switch (ignition switch) 3 and then to the ignition circuit proper, where there is a connection to a primary winding 6 belonging to an ignition coil 5. The other connection of the primary winding 6 goes, first through an electronic interrupter 7 and then through a measuring resistor 8, to a connection to the ground line 2. The positive voltage bus 4 also has a connection in the anode of a diode 9 provided for protection against false polarity, and from the cathode of that diode there is a connection to a buffer capacitor 10, the other electrode of which is connected to the ground line 2.

Figure 2:
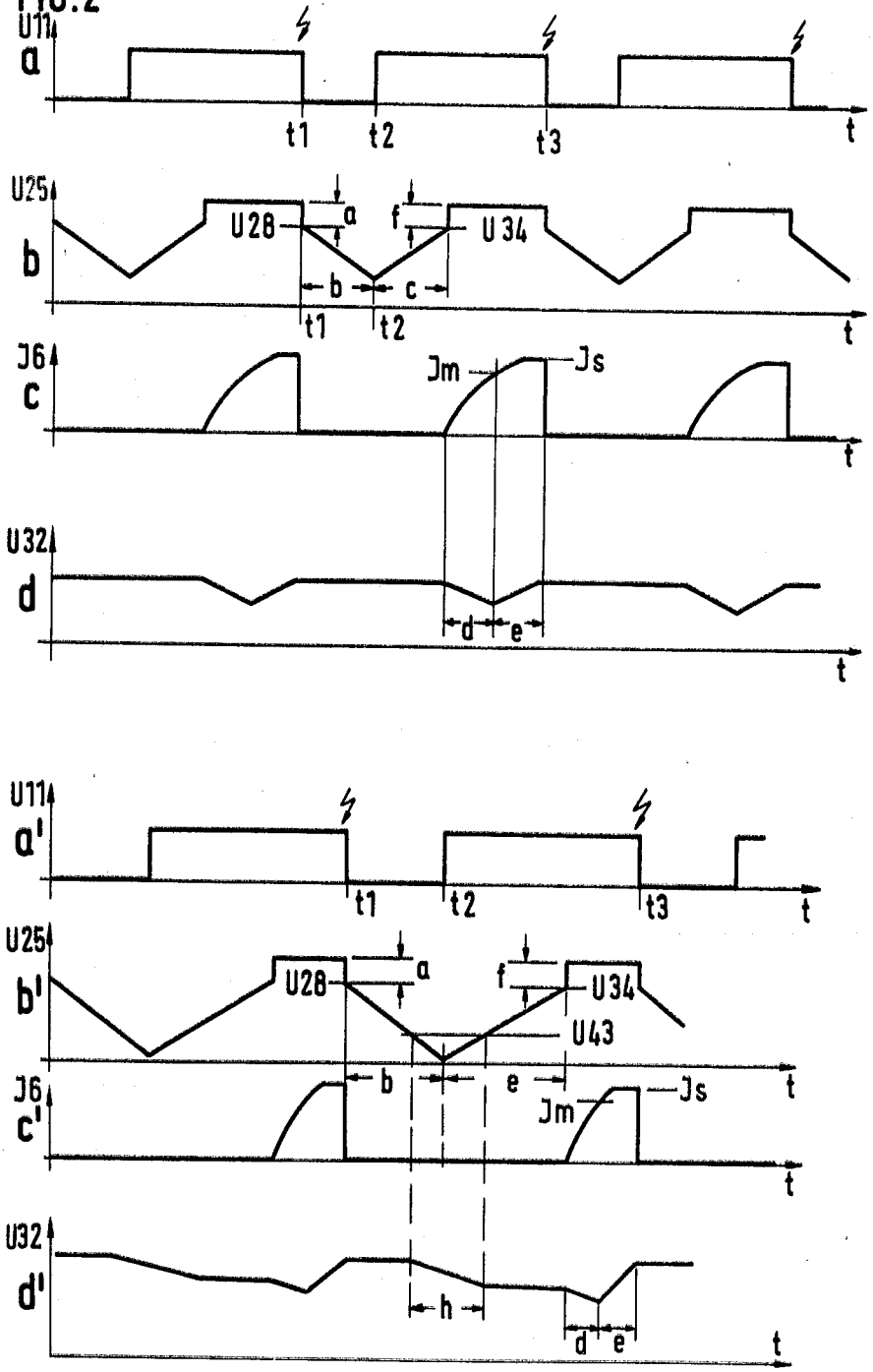
FIG. 2 is a timing chart illustrating on eight base lines graphs of electrical magnitudes varying at different places in the circuit.

A signal generator 11, in the illustrative case a Hall generator, is provided for initiating the ignition process. The signal generator 11 accordingly has a permanent magnet 12 of which the magnetic effect on the Hall element 13 can be transiently set free and interrupted by a diaphragm 14 driven by the internal combustion engine and having an aperture for allowing the magnetic field to extend therethrough. In the moment in which the effect of the magnet freely passes through the diaphragm 13, a switching path 15, which in the illustrated case can be the emitter-collector path of a transistor (although it is not shown as such in the drawing) is brought into the conducting condition. When the Hall element 13 is again covered by the diaphragm 14, the switching path 15 goes into the blocking or nonconducting condition. On the top graph a of FIG. 2 is given the course of the voltage U11. During the time interval t1–t2 the switching path 15 is in the conducting condition and during the time interval t2–t3 it is in the blocking condition. At every switching over of the switching path 15 into the conducting condition, namely at the moments t1 and t3, an ignition spark is intended to be produced as indicated by the zig-zag arrows in the top portion of FIG. 2.

In the fifth graph of FIG. 2, counting down from the top, designated a' at the left there is a plot of the same quantities where the time scale is expanded, but this change of the time scale is to be regarded as of no significance. The same applies to the difference in the time scale between the similar graphs on the second and sixth lines, between the similar graphs on the third and seventh line and between the similar graphs between the fourth and eighth lines.

The signals generated by the switching path 15 are supplied to a control circuit 16 for controlling in turn the switching paths of the switching devices 17, 18, 19, 20 and 21 as indicated in FIG. 1 by broken lines. The switching paths 17 and 18 are in series and the end of this series combination at the switching path 17 is connected through a constant current source 23 to the cathode of the protective diode 9. The end of the series combination of paths 17 and 18 at the switching path 18 is connected through a constant current source 24 to the ground line 2. The common connection that joins the switching paths 17 and 18 has a connection through a storage device 25 to the ground line 2. In the preferred case the storage device 25 is a capacitor 26 to one electrode of which the ground line 2 is connected. The other electrode of the capacitor 26 is the starting point for a connection that leads to the anode of a blocking diode 27 and then continues again from the cathode of that diode through the switching path 19 and thereafter through a constant current source 28 to the ground line 2. One input 29 of a comparator 30 is connected to one terminal of the switching path 21. The other terminal of the switching path 20 is connected to the ground line 2 and the other terminal of the switching path 21 is connected to the terminal of the capacitor 26 that is not connected to the ground line 2. The comparator 30, as shown by another broken line, controls the switching path 31 which is interposed between the cathode of the protective diode 9 and the terminal of the capacitor 26 which is not connected to the ground line 2.

A regulating value is formed by the operation of an integrator 32 and this value is furnished to the other input 33 of the comparator 30. The integrator 32 has a capacitor 34 and two constant current sources 35 and 36. One terminal of the capacitor 34 is connected to the ground line 2 and the other one to the input 33 of the comparator 30. A connection leads from the protective diode 9 through the constant current source 36, then across a switching path 37, thereafter across another switching path 38 and finally through the constant current source 25 to the ground line 2. The common connection joining the switching paths 37 and 38 is also connected to the connection between the capacitor 34 and the input 33 of the comparator 30.

A monitoring device 39 is provided for the storage device 25. As shown in FIG. 1, just as the storage device 25 is illustrated by a capacitor 26, the monitoring device 39 is illustrated by a comparator 40, which is the preferred way of providing the monitoring device. The comparator 40 has one input 41 connected to that terminal of the capacitor 26 that is not connected to the ground line 2 and has its other input 42 connected through a reference element 43 to the ground line 2. The output of the comparator 40 is connected to one input 44 of an OR-gate 45 which controls the switching path 38 as indicated by a short-dashed line. The other input of the OR-gate 45 is connected to the output of an AND-gate 47. One input 48 of the AND-gate 47 is connected to output of the comparator 30, whereas the other input 49 is invertingly connected to the output of the comparator 50. The comparator 50 has one input 51 connected to the connection that runs from the electronic switch 7 to the measuring resistor 8, whereas the other input 52 of the comparator 50 is connected through a constant current source 53 to the ground line 2. The output of the comparator 50 is arranged (by circuit means not shown) to control the switching path 37 as indicated by another broken line.

A limiting circuit 54 is provided for the current that goes through the primary winding 6. This limiting circuit contains at least a transistor 55 arranged to be controlled in dependence on the voltage across the measuring resistance 8 and it has its emitter-collector path connected between the ground line 2 and the control line 56 which represents the operative connection between the output of the comparator 30 and the electronic interrupter 7. The electric interrupter 7 is constituted at least by a transistor 57. The secondary winding 58 coupled to the primary winding 5 is connected through at least one spark plug 59 to the ground line 2.

Operation of the Circuit of FIG. 1

As soon as the ignition switch 3 is closed, the system is ready to function. It will be assumed now that the ignition operation has already taken place and that the pulse interval t1–t2 has just begun (line a of FIG. 2). The control unit 16 has therefore brought its switching paths 18, 19 and 20 into the conducting condition and its switching paths 17 and 21 into the blocking condition. By the transition of the switching path 20 into the conducting condition the comparator 30 is caused to bring the switching path 31 into the blocking condition. By the conduction of the switching path 19 it is provided that the storage content in the storage device 25 undergoes a temporary change a (voltage U25 plotted against time on line b of FIG. 2). In the illustrated case the capacitor 26 that constitutes the storage device 25 first jumps by discharge to the voltage U28 of the constant current source 28, after which a gradual discharge b continues through the current conducting switching path 18 and the constant current source 24 until the moment t2, i.e. therefore until the opening of the switching path 15. The transition of the switching path 15 into the blocking condition causes the control unit 16 to bring its controlled switching path 18, 19 and 20 into the blocking condition and its controlled switching paths 17 and 21 into the conducting position. A second change c of the storage content of the storage device 25 then takes place through the current-conducting switching path 17 and then the blocked paths 18 and 19. The capacitor 6 constituting the storage device 25 is then charged up through the constant current source 23. When in the course of the second change c of the storage content present in the storage device 25 the storage content is reached that corresponds to the voltage U34 at the capacitor 34, the comparator 30 switches over and delivers at its output a signal that brings the electronic interrupter 7 into its conducting condition and thereby makes provision for a current build-up in the primary winding 6 (lines b and c of FIG. 2, the latter plotting the current against time).

With the rise of current in the primary winding 6 a growing voltage drop appears at the measuring resistance 8. So long as the voltage at the measuring resistance 8 has not yet reached the comparison voltage at the constant voltage source 53, no signal will be produced at the output of the comparator 50. Since the connection leading to the input 49 of the AND-gate 47 from the output of the comparator 50 is inverted at the AND-gate 47, when the comparator 50 produces a signal the AND-gate is blocked and the signal at its output disappears.

So long as the speed of the engine remains above its idling speed, no signal will be provided at the output of the comparator 40, so that when the signal at the input 46 of the OR-gate 45 disappears, the switching path 38 controlled by the OR-gate 45 goes into its blocking condition. There follows in consequence a second change e of the integration value present in the integrator 32. This second change of the integration value is an upward integration, namely a charging up of the capacitor 34 by the constant current source 36 (see line d of FIG. 2). This second change of the integration value terminates at the ignition moment t3 (line a of FIG. 2), because at that moment the switching path 15 of the engine-driven signal generator 11 is again put into the conducting condition and the control unit 6 causes its control switching path 18, 19 and 20 to go into the blocked condition and its switching paths 17 and 21 to go into the conducting condition. The input 29 of the comparator 30 is then connected to the ground line 2 through the switching path 20, so that the signal at the output of the comparator 30 disappears and the electronic interrupter 7 is put into its blocking condition. That produces interruption of the current flowing through the primary winding 6, resulting in a high voltage pulse in the secondary winding 58 and, in consequence thereof, an electrical breakdown (ignition spark) at the spark plug 59. At the same time the voltage across the measuring resistance 8 drops to zero, in consequence of which the comparator 50 brings the switching path 37 which it controls into the blocking condition. Since at this time the control line 56 is also without a signal, the switching path 38 for the time being is not brought back into the conducting condition.

The integration value in the integrator 32, which is the charge voltage of the capacitor 34, constitutes a regulating value by which it is possible to change the threshold storage value that constitutes the comparison value at the input 33 of the comparator 30.

When in the course of the storage of the ignition energy provided by the current caused to flow in the primary winding 6, a prescribed value Is (see line c of FIG. 2) which is a value of current at which the stored energy in the primary winding is sufficient for an effective ignition spark has been reached, the current limiting device 54 comes into operation, by diverting away just enough control current supplied to the electronic interrupter 7 to prevent the current allowed to flow through the primary winding 6 from increasing above this prescribed value Is.

The second change c of the storage content of the storage device 25 (capacitor 26) is likewise modified by a momentary change f (see line b of FIG. 2) when as a result of the switchover of the switching path 31 into the conducting state the capacitor 26 (the storing device 25) rises in a jump to the voltage of the buffer capacitor 10. It has been found that as the result of the jump-like change a of the storage content, the formation of the regulation value is only insignificantly affected even with greatly different magnitude relations between blocking period and current passing period (i.e. keying ratio) of the switching path 15 of the engine-driven signal generator 11.

When the engine runs at a steadyspeed there is provided, after the second change e of the integration value (see line d of FIG. 2) about the same value that was present before the first change of the integration value. When by starting up of the engine, however, the speed rises very rapidly, it can occur that the electronic interrupter 7 is not switched into the circuit at all. In order to remedy this deficiency, the voltage U43 at the reference element 43 (constant voltage source, for example—see line b' of FIG. 2) provides a reference storage content value which, when it is reached by the content of the storage device 25, produces a switching over of the comparator 40. The signal that then appears at the output of the comparator 40 goes to the input 44 of the OR-gate 45, so that the switching path 38 controlled by the gate is thereby brought into conducting condition. A supplementary change h (line d' of FIG. 2) is then produced which has the effect of the completion of the first change d of the integration value. By this supplementary change the reference storage content value at the input 33 of the comparator 30 is reduced to such an extent, and the switching over of the electronic interrupter 7 is in consequence advanced to such an extent (line c' of FIG. 2), that even in starting operation with rapid rise of speed enough ignition energy is stored in the ignition coil 5.

It is necessary to take care in the signal generator 11 that the duration of the conducting condition of the electronic interrupter 7, in comparison to the duration of the switching condition which the switching path 15 of the generator 11 has immediately before its switching over in the ignition moment t1 and t3, can be made shorter with increasing speed by some kind of regulation.

It is however, desired by customers at times that the duration of the conducting condition of the electronic interrupter 7, as compared with the duration of the condition of the switching path of the signal generator immediately before switching over at the ignition moment, should be allowed to become longer with increasing engine speed. The use of a signal generator meeting such requirements would necessitate an ignition system of greater complication and expense than the system of FIG. 1. On the other hand, when such a signal generator is used, the risk does not exist that ignition failures may occur during rapid acceleration during starting up, because a minimum duration of the conducting condition of the electronic interrupter 7 is assured. According to the invention the result can be obtained with relatively small initial expense if on the basis of an ignition system according to FIG. 1 the option is available also to use a signal generator 11 of the kind above-described. An ignition system of that sort is shown in FIG. 3.

Figure 3:
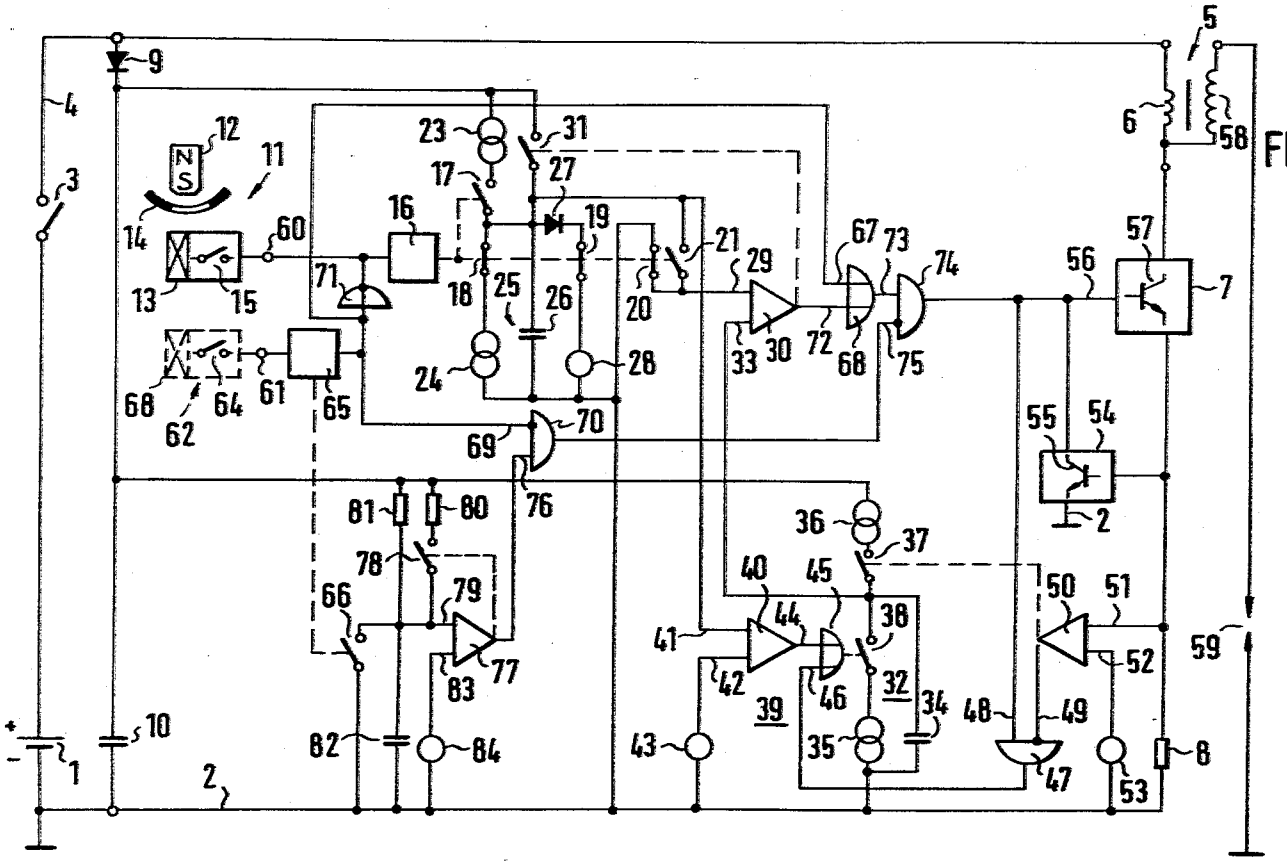
FIG. 3 is a diagram of an ignition system according to the invention that is more completely equipped compared to FIG. 1

In FIG. 3 the circuit components comparably situated and having the same function as those shown in FIG. 1 are designated with the same reference numerals and are not further explained. The control connection that is provided for the signal generator of FIG. 1 is here referred to as the main control connection and designated with the reference numeral 60. Along with that is provided an auxilliary control connection 60, where as an alternative a signal generator 62 could be connected, of the kind described above.

For reasons of simplicity of explanation only the Hall element 63 and the switching path 64 are shown for the signal generator 62, because the permanent magnet and diaphragm have the same operation in the signal generator 62 as shown in FIG. 1. In the ignition system the auxilliary control connection 61 is connected with a control unit 65 which controls a switching path 66 as indicated by a broken line.

The signals at the auxilliary control connection 62 are supplied to the output of the control unit 65, to the input 67 of an OR-gate 68, to the inverting input 69 of an AND-gate 70 and through a reversal stage 71 to the input of the control unit 16. The other input 72 of the OR-gate 68 is connected to the output of the comparator 30. The output of the OR-gate 68 is connected with one input 73 of an AND-gate 74 of which the other input, the inverting input 75, is connected to the output of the AND-gate 70. The control line 56 for the electronic interrupter 7 is connected to the output at the AND-gate 74. The other input 76 of the AND-gate 70 is connected to the output of a comparator 77 which controls a switching path 78, as the magnet and diaphragm of the signal generator 62 operate in the same way as occurs in FIG. 1. The switching path 78 is interposed between the input 79 of the comparator 77 and a measuring resistance 80 which, at its other end, is connected to the cathode of the protective diode 9. Furthermore, the input 79 of the comparator 77 is connected through a measuring resistance 81 to the cathode of the protective diode 9. Finally, the input 79 of the comparator 77 has a further connection over the switching path 61 controlled by the control unit 65, across which a shunt capacitor 82 is provided to the ground line 2. The other input 83 of the comparator 77 is connected through a constant voltage source 84 to the ground line 2.

The circuit of FIG. 3 has, in comparison to FIG. 1, the following additional manner of operation, explained with reference to the diagrams given in FIG. 4 which are based on those of FIG. 2, keeping the same reference numerals and symbols where the same events are involved.

Operation of Circuit of FIG. 3

By means of the inverting stage 71 the pulses t2–t3 appearing at the output of the control unit 65 (line a of FIG. 4) and also delivered by the signal generator 62 to the auxilliary control connection 61 are reversed in their effectiveness and in the inverted form (voltage U71 plotted against time t in line b of FIG. 2) are supplied to the input of the control unit 16. The first change b and the second change c of the storage content of the storage device 25 (line c of FIG. 2) now proceeds just as was already explained with reference to FIG. 1. Then, when the storage content of the storage device 25 during its second change c reaches the threshold U34, a signal is made available at the output of the comparator 30 and also at the output of the OR-gate 28 which can reach the electronic interrupter 7 through the AND-gate 74 and there bring about the conducting condition, if a sufficiently long duration of the blocking position has there taken place after the ignition event (voltage U30 in line d of FIG. 2 and voltage U74 in line e of FIG. 2). That is, when the switching path 64 of the signal generator 62 is put into the blocking condition, the switching path 66 goes into its conducting condition. This has the consequence that the capacitor 82 is discharged (voltage U83 in line g of FIG. 4). At the same time the conducting condition of the switching path 66 produces a signal at the output of the comparator 77 (voltage U77 in line h of FIG. 2), which puts the switching path 78 into its blocking condition. When, at the moment of ignition, the switching path 64 of the signal generator 62 is put into its conducting condition, the control unit 64 produces the switching over of the switching path 66 into its blocking condition. The capacitor 83 is now charged over the resistor 81 until it reaches the comparison voltage U84 of the constant voltge source 84 (line g of FIG. 2). The switching over of the switching path 78 into the conducting condition then takes place, so that the capacitor 83 can rapidly charge up to the final value. The time period over which no signal is present at the auxilliary control connection 61 and therefore also at the output of the control unit 65 (line a of FIG. 4), while the comparator 77 still is activated because of the charging up of the capacitor 83 (line h of FIG. 4) is determined by the AND-gate 70 which provides a signal (voltage U70) (in line i of FIG. 4) which holds the AND-gate 74, on account of the negation function at the input 75 of the latter, in its blocked condition for the duration of this pulse. In this way it is prevented that the switching over of the electronic interrupter 7 into the conducting condition could take place immediately after the ignition event, so that no time would be available for development of the ignition spark.

Figure 4:
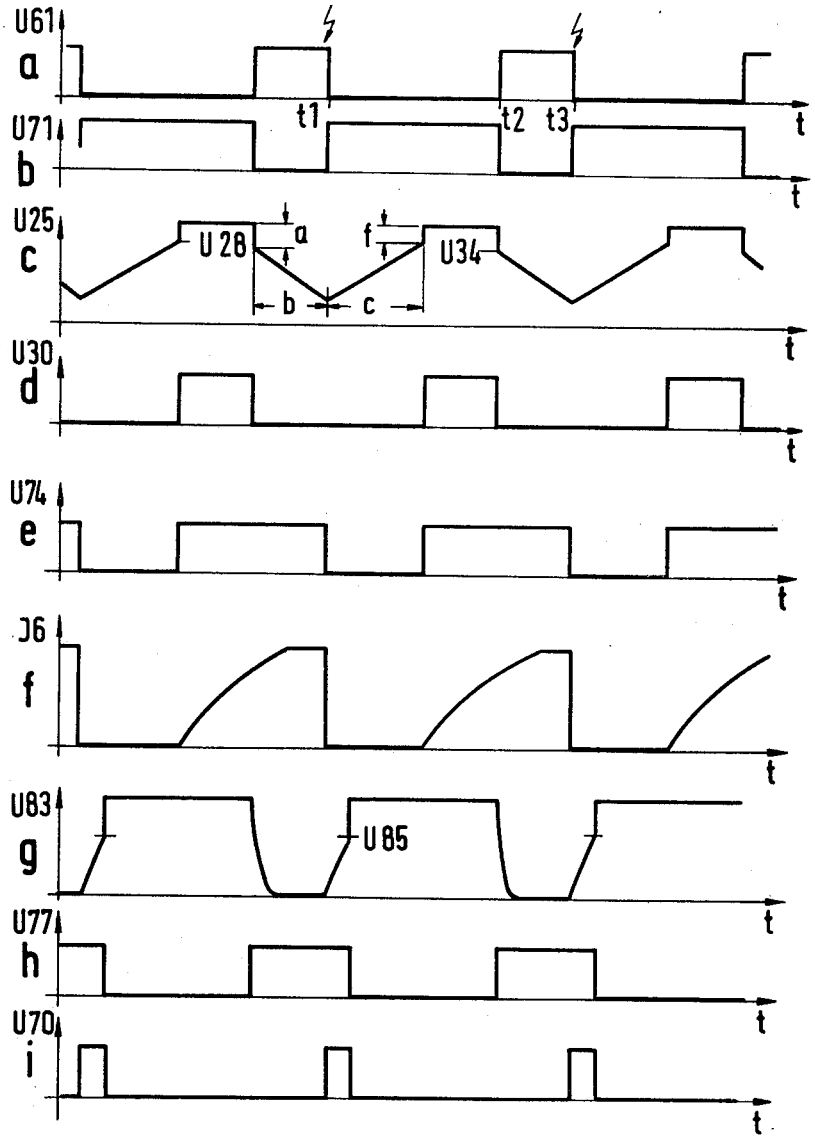
FIG. 4 is a timing chart showing the variation of nine electric magnitudes at various places in the circuit of FIG. 3, all drawn to the same time scale.

The connection from the output of the control unit 65 to the input 67 of the OR-gate 68 assures that the initiation of ignition takes place on the trailing flank t1–t3 of the pulse as in the case of FIG. 1 (line a of FIG. 4). Then during the interval in which the switching path 64 of the signal generator 62 is in the blocking condition, the electronic interrupter 7 will in every case have the current conducting condition. The switching over into the conducting condition is then, as also in the case of FIG. 1, produced by the change of the integration value in the integrator 32 and by the shift dependent thereon of the threshold storage content value at the comparator 30, which shifts to an earlier time with increasing engine speed.

When the signal generator 62 is used the comparator 40 is not needed, so that with the connection of the signal generator 62 an automatic rearrangement of the circuit can be caused to take place so that the comparator 40 takes over the function of the comparator 77, thus making the separate comparator 77 unnecessary.

The switching paths 15, 17, 18, 19, 20, 21, 31, 37, 38, 64 and 78 are preferably constituted according semiconductor technology.

Although the invention has been described with reference to particular illustrative embodiments, it will be understood that variations and modifications are possible within the inventive concept.

I claim:

1. An ignition system for internal combustion engine including an ignition coil having a primary winding and a secondary winding and an electronic interrupter in series with said primary winding and also an engine driven signal generator having a first switching path for timing the ignition moment at which said interrupter is caused to interrupt the current of said primary circuit when said first switching path switches over from one state to another, the ignition system including means for causing the duration of the conducting condition of said electronic switch, as compared to the duration of the switching condition of said first switching path immediately before switching over at an ignition moment, to become increasingly shorter as engine speed slows, said system having also a storage element and means for providing a first change of the storage content thereof over the duration of the condition of said first switching path that follows immediately after an ignition moment and thereafter a change of said storage content in the other direction and means for the switching over of said electronic interrupter into its conducting state when said storage content reaches a threshold value during said second change of said storage content, as well as means for modifying said threshold value by means of a regulating value dependent at least in part on engine speed, in which system, in accordance with the invention there are also provided:

a monitoring circuit responsive to the storage contents of said storage element for providing a signal when said storage content reaches a reference value that corresponds to an engine speed lying below the idling speed of the engine and for thereby modifying said regulating value so that said threshold value is reached sooner.

2. An ignition system as defined in claim 1 in which said storage element is a capacitor, said first change (d) of said storage content is a change in charge of said capacitor in a first current direction and said second change (c) of said storage content is a change in charge of said capacitor in the other direction of current.

3. An ignition system as defined in claim 2 in which means are provided for producing said changes in charge at constant current.

4. An ignition system as defined in claim 1 in which said first change in storage content is preceded by a momentary rapid change (a) in the same direction and said second change (c) is immediately followed by a momentary rapid change (f) in the same direction as said second change.

5. An ignition system as defined in claim 1 in which means are provided for generating said regulation value as an integration value formed in an integrator (32).

6. An ignition system as defined in claim 5 in which means are provided for closing the beginning of a first change (d) of the integration value present in said integrator (32) in response to the switching over of said electronic interrupter (7) into the conducting condition, in which means are also provided for terminating said first change (d) of said integration value and the beginning of a second change (e) of the integration value then present in response to the rise of the current flow in said primary winding (6) to a predetermined measuring value (Im), and in which means are provided for terminating said second change (e) in response to the switching over of said electronic interrupter (7) into the blocking condition, as well as means for at least approximately maintaining the integration value present in said integrator (32) after said second change (e) in value thereof until the beginning of a new first change wherein said engine is running at a speed higher than its idling speed.

7. An ignition system as defined in claim 1 in which a comparator (30) is provided for comparison of said storage content with said regulating value, the output of said comparator (30) being connected for control of said electronic interrupter (7).

8. An ignition system as defined in claim 1 in which said monitoring circuit comprises a comparator (40) having one input (41) connected for obtaining said storage content of said storage device (25) and having its other input (42) connected with a reference element (43) providing a corresponding comparison value.

9. An ignition system as defined in claim 8 in which said reference element is a voltage source.

10. An ignition system as defined in claim 9 in which the output of said comparator (40) is connected operatively with said integrator (32) in such a way that when said storage content reaches said reference value a supplementary change (h) of the integration value of said integrator (32) is produced that functions as the completion of said first change of said integration value.

11. An ignition system as defined in claim 1 including provisions for incorporating, by way of alternative for said signal generator, a different engine driven signal generator likewise equipped with a switching path for timing the ignition moment and arranged to control said last mentioned switching path to assure that the duration of the conducting condition of said electronic interruptor (7), as compared with the duration of the switching state in which said last mentioned switching path (64) finds itself immediately before the switch-over at the ignition moment, will become longer with increasing engine speed, said ignition system including an auxilliary terminal (61) for connection of the remainder of the system to said last mentioned switching path (64).

12. An ignition system as defined in claim 11 in which a second control unit (65) is provided for operating at least one further switching path (66) and also supplying a control output and in which an inverting circuit (71) is provided between said control output of said second control unit and the output terminal of said first switching path (15).

13. An ignition system as defined in claim 12 including means for assurance that said electronic interrupter (7) is and remains in the conducting state during the entire period for which said switching path (64) of said alternative signal generator is in the state which it has immediately preceding the switch-over at the ignition moment.

14. An ignition system as defined in claim 13 having also means for assuring that said electronic interrupter (7) is presented from returning to the conducting state for a predetermined period of time immediately following an ignition-producing switchover of said interrupter (7).

* * * * *